US005242136A

United States Patent [19]

Cribbens et al.

[11] Patent Number: 5,242,136

[45] Date of Patent: Sep. 7, 1993

[54] RAILWAY SIGNALLING SYSTEMS

[75] Inventors: Alan H. Cribbens, Belper; Malcolm S. Sutton, Borrowash Derby, both of United Kingdom

[73] Assignee: British Railways Board, United Kingdom

[21] Appl. No.: 852,135

[22] PCT Filed: Nov. 16, 1990

[86] PCT No.: PCT/GB90/01766

§ 371 Date: Apr. 29, 1992

§ 102(e) Date: Apr. 29, 1992

[87] PCT Pub. No.: WO91/07302

PCT Pub. Date: May 30, 1991

[30] Foreign Application Priority Data

Nov. 17, 1989 [GB] United Kingdom ..... 8926060

[51] Int. Cl.[5] ..... B61L 13/04; B61L 29/22

[52] U.S. Cl. ..... 246/34 R; 246/187 R; 246/194

[58] Field of Search ..... 246/28 F, 28 K, 34 R, 246/34 C, 34 CT, 40, 121, 125, 128, 167 R, 169 R, 178, 180, 182 R, 187 R, 187 A, 192, 193, 194, 196, 197

[56] References Cited

U.S. PATENT DOCUMENTS

| | | | |
|---|---|---|---|
| 1,302,345 | 4/1919 | Finnigan | 246/194 X |
| 1,822,497 | 9/1931 | Loomis | 246/193 X |
| 2,817,012 | 12/1957 | Kendall | 246/124 |
| 3,270,199 | 8/1966 | Smith | 246/182 C |
| 3,387,064 | 6/1968 | Joy et al. | 246/121 X |
| 3,913,874 | 10/1975 | Barpal | 246/182 R |
| 4,041,448 | 8/1977 | Noens | 246/167 R X |
| 4,420,133 | 12/1983 | Dietrich | 246/167 R |
| 4,720,067 | 1/1988 | Jaeger | 246/167 R X |
| 5,170,970 | 12/1992 | Ballinger | 246/34 R |

FOREIGN PATENT DOCUMENTS 2332483 1/1975 Fed. Rep. of Germany .

OTHER PUBLICATIONS

Thomas K. Dyer, Inc., "Lightweight Vehicle Track Shunting", published in Apr. 1981, by the U.S. Department of Commerce National Technical Information Service, see pp. 33 to 35 Modifications to the Rail Vehicle.

*Primary Examiner*—Frank E. Werner
*Assistant Examiner*—Scott L. Lowe
*Attorney, Agent, or Firm*—Davis, Bujold & Streck

[57] ABSTRACT

A railway signalling system for the detection of a train within a defined section of track by means of track circuit apparatus utilizes the rails within the section as part of the track circuit. The rails are electrically shunted by the wheels and axles of a railway vehicle of the train in the section. The presence of a train is detected by detecting the change in the shunt impedance between the rails of the track circuit when a train enters the section. To improve the reliability of the track circuit a shunt assist circuit is provided. This shunt assist circuit comprises an inductive loop aerial provided on the railway vehicle so that it is closely coupled, inductively, with the rails, whereby when the loop aerial is energized from an alternating source, a current is induced in the wheel-rail-axle circuit.

6 Claims, 4 Drawing Sheets

RAILWAY SIGNALLING SYSTEMS

This invention relates to railway signalling systems and specifically to the detection of a train within a defined section of track by means of track circuit apparatus utilizing the rails within the section as part of the track circuit.

Such track circuits detect the presence of trains in a track section by detecting the change in the shunt impedance between the running rails of the track circuit. When a train enters the sections, the wheels and axles of the train present a low impedance, henceforth called the train shunt impedance, between the rails and in parallel with the existing shunt resistance formed by the track ballast, henceforth called the ballast resistance. This is illustrated in the accompanying FIGS. 1*a* and 1*b*.

FIG. 1*a* shows a track section defined by insulated joints X at the ends of rails 1 and 2. A source of electricity diagrammatically represented by battery 3 is connected across the rails 1 and 2 at one end of the section and a detector 4 is connected across the rails at the other end of the section to complete the track circuit through the rails. In the condition shown in FIG. 1*a* the detector 4 would register the voltage applied across the rails, less any losses along the track section through ballast resistance, hence indicating that there is no train in the section.

When a wheel/axle set 5 enters the track section as shown in FIG. 1*b* and provided that the wheel/axle set 5 makes good electrical contact with the rails 1 and 2, the voltage at the detector 4 falls nearly to zero as a result of the low train shunt impedance. This condition of the track circuit is interpreted as track section occupied by the signalling system.

Present day railway signalling depends on reliable detection of the occupancy of track sections. Decisions made by signalmen or signalling equipment as a result of faulty detection could lead to unsafe situations developing.

The reliable operation of the track circuit depends upon good electrical contact between the wheels and rails and good electrical conductivity of the wheel/axle set so that the train shunt resistance is low enough to provide in effect a short circuit between the rails. Under certain conditions however the rail-wheel-axle-wheel-rail circuit is not as good an electrical conductor as is required for reliable operation of the train detection circuitry. This is mainly caused by the growth of surface films, for example, rust films on the rails from place to place along the rails. This is particularly noticeable in the case of modern designs of multiple unit rolling stock.

The presence of a contaminant such as a rust film between the wheels and rails will form a layer of insulating and/or semiconducting material. To overcome the electrical barrier so formed there are two mechanisms which may be considered, namely:

1. Breaking down the insulating layer by application of a suffficiently high voltage, and
2. Minimizing the effect of the semiconducting property by biasing the wheel/rail contacts to a working level where the electrical resistance is sufficiently low to permit the track circuit to operate satisfactorily.

It is already known to provide a so-called shunt assist circuit in order to overcome the aforesaid electrical barrier. One such circuit is described in an article entitled "Lightweight Vehicle Track Shunting" by Thomas K. Dyer, Inc. published in April 1981 by the U.S. Department of Commerce National Technical Information Service. In this article is described a shunt assist circuit comprising an excitation circuit which circulates a relatively high amperage 400 cps current from wheel to rail and back to wheel of a train unit. It is stated that this breaks down the rail-wheel resistance and improves the shunting by a wheel/axle set very effectively. The excitation circuit consists basically of a transformer, the turns of the transformer primary being wound around a first axle of a truck or bogie. The power is supplied to the transformer primary from a small on-board alternator. The secondary of the transformer comprises a single turn formed by said first axle a second axle of the train unit spaced from said first axle and the two rails between said first and second axles.

In order to provide the secondary winding in this way it is necessary to insulate said first axle from the rest of the bogie. This is not only disadvantageous from the manufacturing point of view but also for retrofitting the shunt assist system to existing vehicles.

SUMMARY OF THE INVENTION

The object of the invention is to provide a shunt assist circuit which does not suffer from the aforesaid disadvantages.

According to the present invention a shunt assist circuit is characterized in that an inductive loop aerial is provided on a railway vehicle so that it is closely coupled, inductively, with the rails whereby when the loop aerial is energized from an alternating source a current is induced in the required wheel-rail-axle circuit.

Thus there is a transformer coupling between the inductive loop aerial constituting the primary and the single turn secondary comprising two spaced wheel-/axle sets and the rails extending between these two sets. However, because the aerial inductively couples directly with the rails there is no need to insulate the two wheel/axle sets from the rest of the bogie or vehicle.

BRIEF DESCRIPTION OF THE DRAWINGS

Shunt assist circuits in accordance with the invention will now be described by way of example with reference to FIGS. 1*a*, 1*b*, and 2 to 4 of the accompanying diagrammatic drawings, in which.

DETAILED DESCRIPTION

Figure 1A:
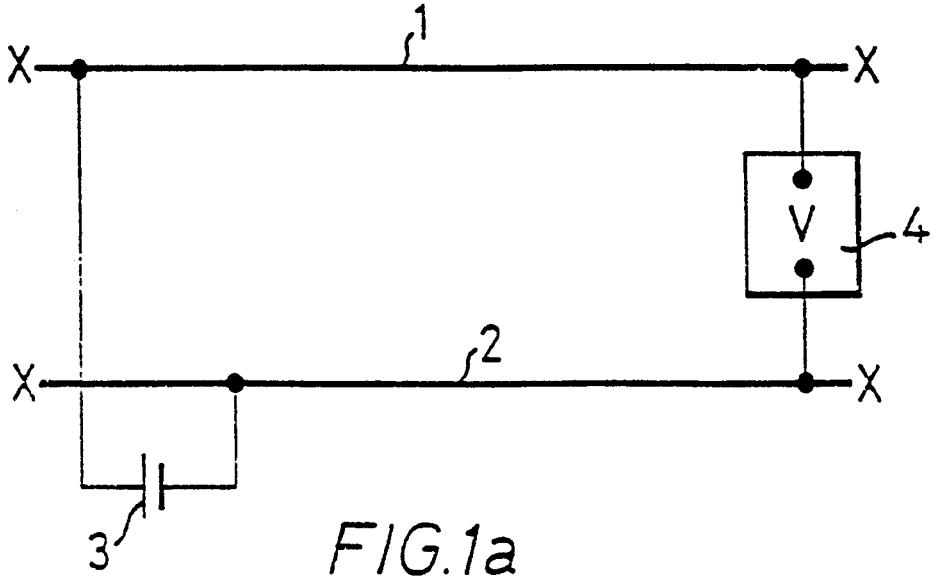
FIG. 1*a* shows a track section.
Figure 1B:
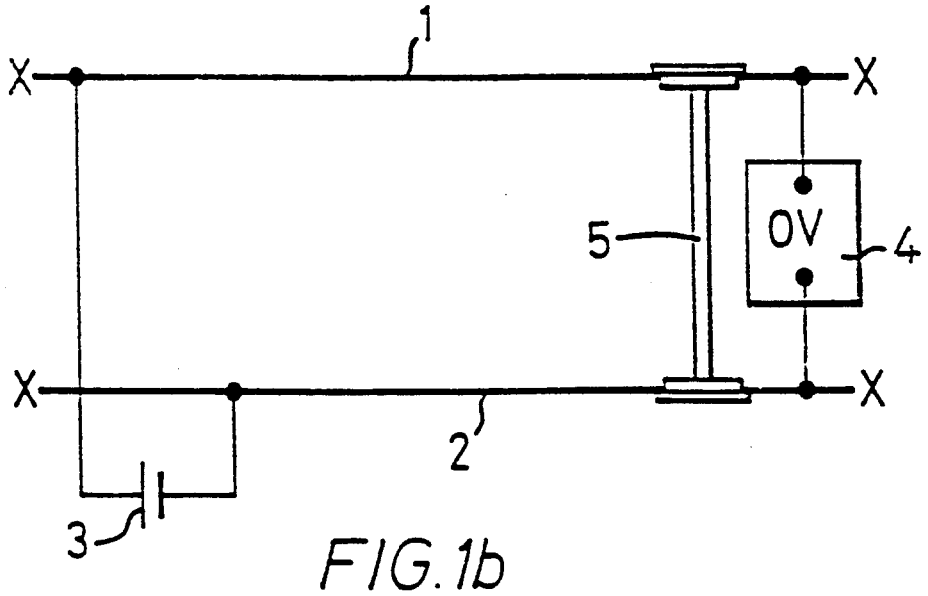
FIG. 1*b* shows a track section occupied by a wheel-/axle set.
Figure 2:
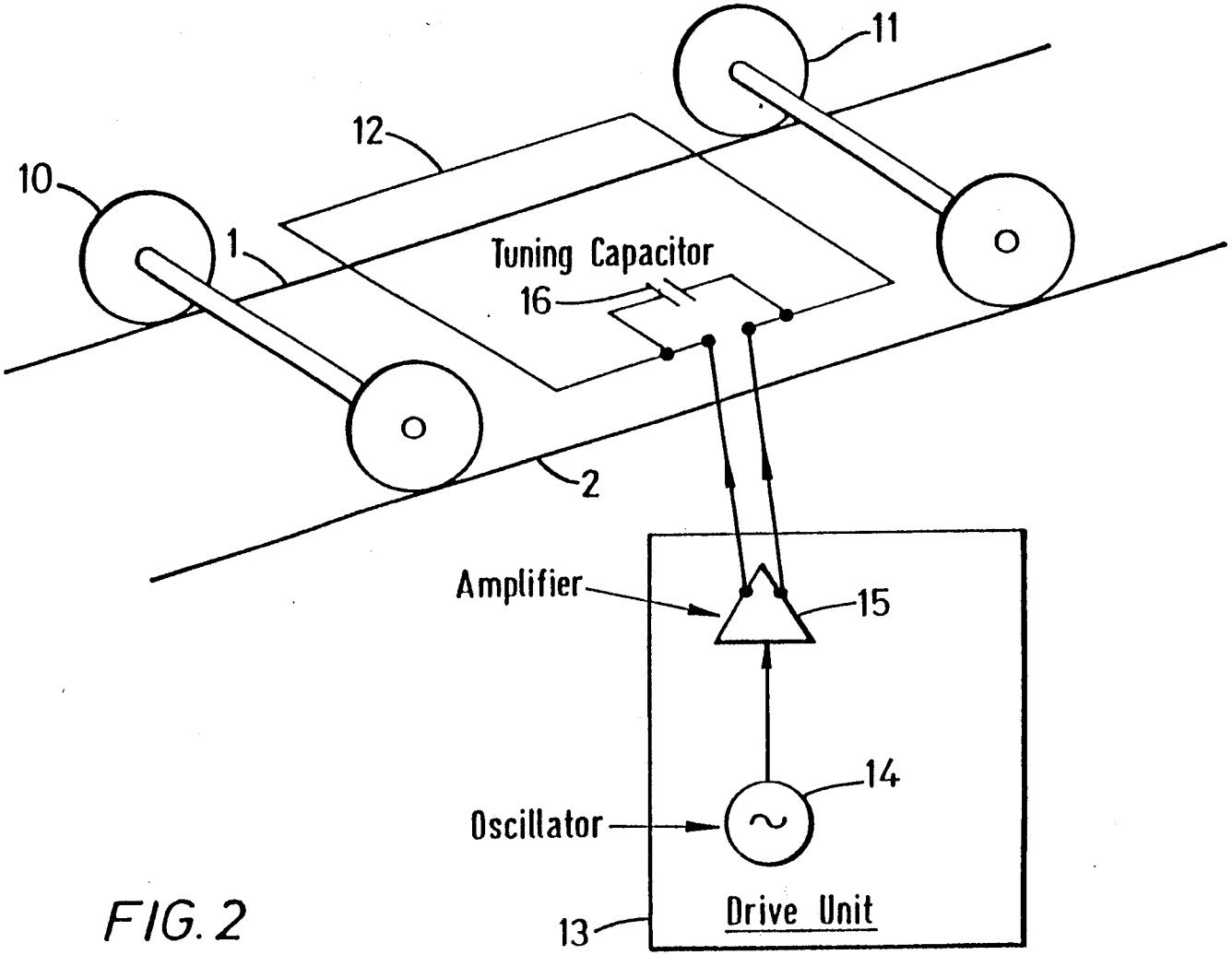
FIG. 2 shows a first shunt assist circuit.

FIG. 2 of the drawings shows a vehicle bogie having two wheel/axle sets 10 and 11 running on the rails 1 and 2. Mounted on the bogie is a loop aerial 12 which inductively couples with the rails 1 and 2 and also with the wheel/axle sets 10 and 11. The loop aerial 12 is powered from a drive unit 13 comprising an oscillator 14 and an amplifier 15 which produces for example a fixed frequency of 165 kHz output. The aerial 12 tuned in situ with a parallel connected tuning capacitor 16 to resonate at the energizing frequency. It is known for efficient power transfer into a reactive load (the loop aerial 12) that the inductive reactance must be compensated by an equivalent capacitive reactance, i.e. the network becomes resonant at the energizing frequency. Thus the loop aerial 12 is tuned to provide high current at low power dissipation in the drive unit 13.

In practice, the magnitude of the inductive reactance of an installed loop aerial is not constant and is also subject to production and installation tolerances. To accommodate this variability the value of the tuning capacitor 16 can be adjusted for individual installations but this may prove inconvenient for large scale implementation. An advantageous alternative is to make the energizing frequency adjustable and employ an optimizing circuit which seeks the frequency at which the system is resonant. This is conveniently implemented with Phase Locked Loop (PLL) techniques which are commonly understood. There are many benefits with this solution; production, installation and aging variations are automatically accommodated.

Figure 3:
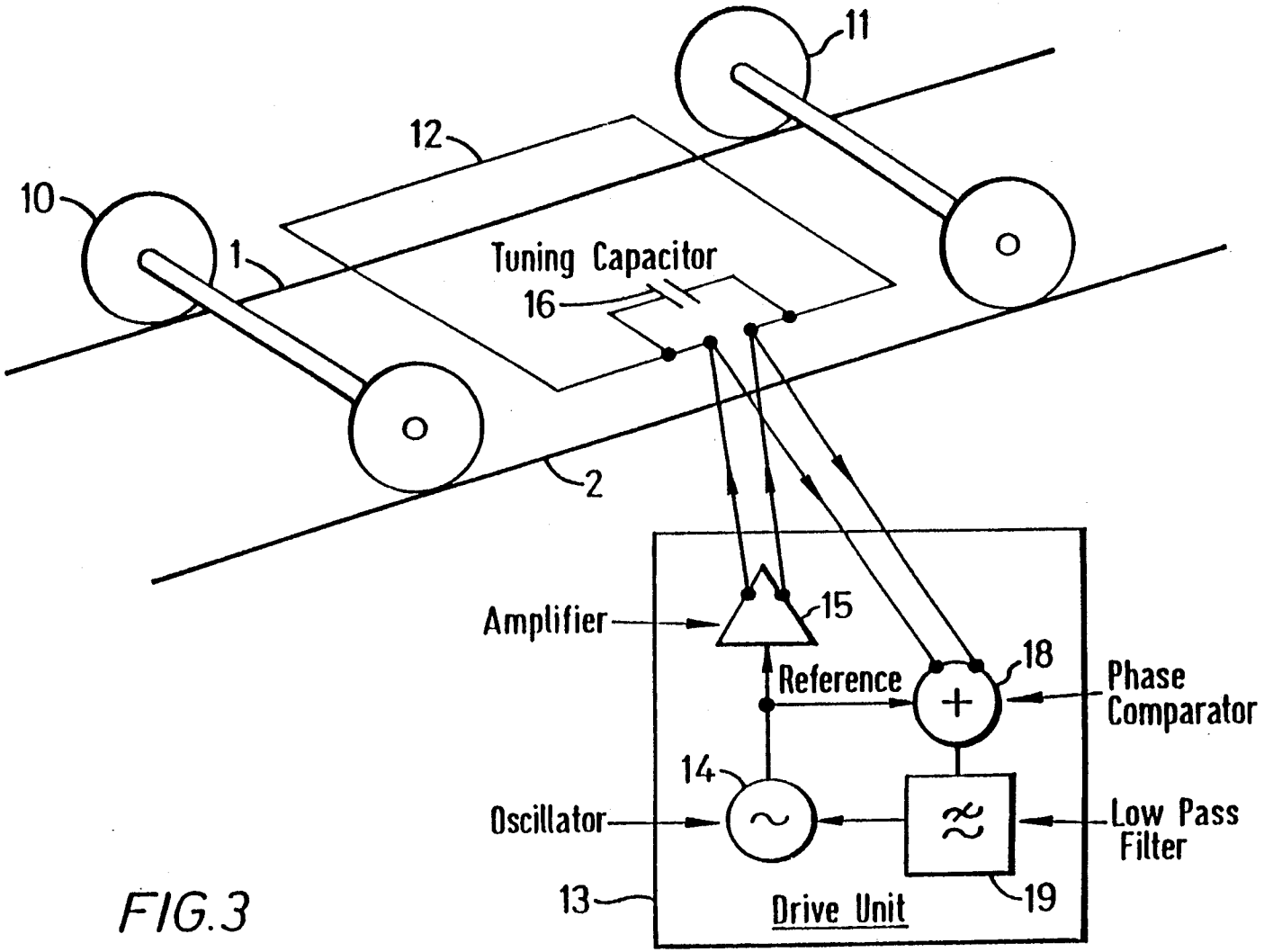
FIG. 3 shows a second shunt assist circuit.

A shunt assist circuit utilizing adjustable frequency is shown in FIG. 3. Referring to FIG. 3, the same reference numerals as in FIG. 2 have been used to designate corresponding items. Thus loop aerial 12 is powered from a drive unit 13 comprising an oscillator 14 and an amplifier 15. A tuning capacitor 16 is connected in parallel with the loop aerial 12 so that the loop aerial resonates at the energizing frequency.

In order to compensate for changes in the inductive reactance of the loop aerial and so substantially avoid a loss of resonance, an automatic control circuit is provided for controlling the output frequency of the oscillator 12 which in this case is advantageously a voltage controlled oscillator. The automatic control circuit comprises a phase comparator 18, which receives as a reference signal the output voltage from the oscillator 14. The phase comparator 18 receives as its comparison signal a voltage signal from the loop aerial 12.

Since the amplifier 15 inherently has a finite output impedance (resistance), when the loop aerial 12 goes off tune, the phase of the amplifier output voltage changes with respect to its input voltage, because of the change in current flowing in the loop aerial circuit. This change in phase appears in the comparison signal fed to the comparator 18.

The output from the comparator 18 is fed via a low pass filter 19 to control the output frequency of the oscillator 14. Thus a change in the phase of the comparison signal will change the frequency of the output from the oscillator 14 in the sense to vary the comparison signal and so restore the phase of the output voltage from the amplifier 15 to its original relationship with the reference signal. Thus the output frequency of the oscillator is adjusted to maintain a substantially zero phase difference between the reference and comparison signals.

In both the embodiments of FIGS. 2 and 3, the loop aerial 12 forms a single turn primary winding of a transformer, the single turn secondary of which comprises the loop formed by the two wheel/axle sets and the lengths of rail 1 and 2 between the two wheel/axle sets. The area of the primary is made as large as possible within the constraints put upon it by the physical design of the vehicle and is for example approximately equal to 50% of the secondary loop. Thus the loop aerial 12 inductively couples directly with the rails 1 and 2.

In the case of a bad wheel to rail contact a voltage of say 10V is generated in the secondary winding at the wheel-rail contact area and it has been found that this is adequate to break down any barrier to current flow in the wheel-rail contact and hence in the shunt path provided by the wheel/axle set within the track circuit.

Figure 4:
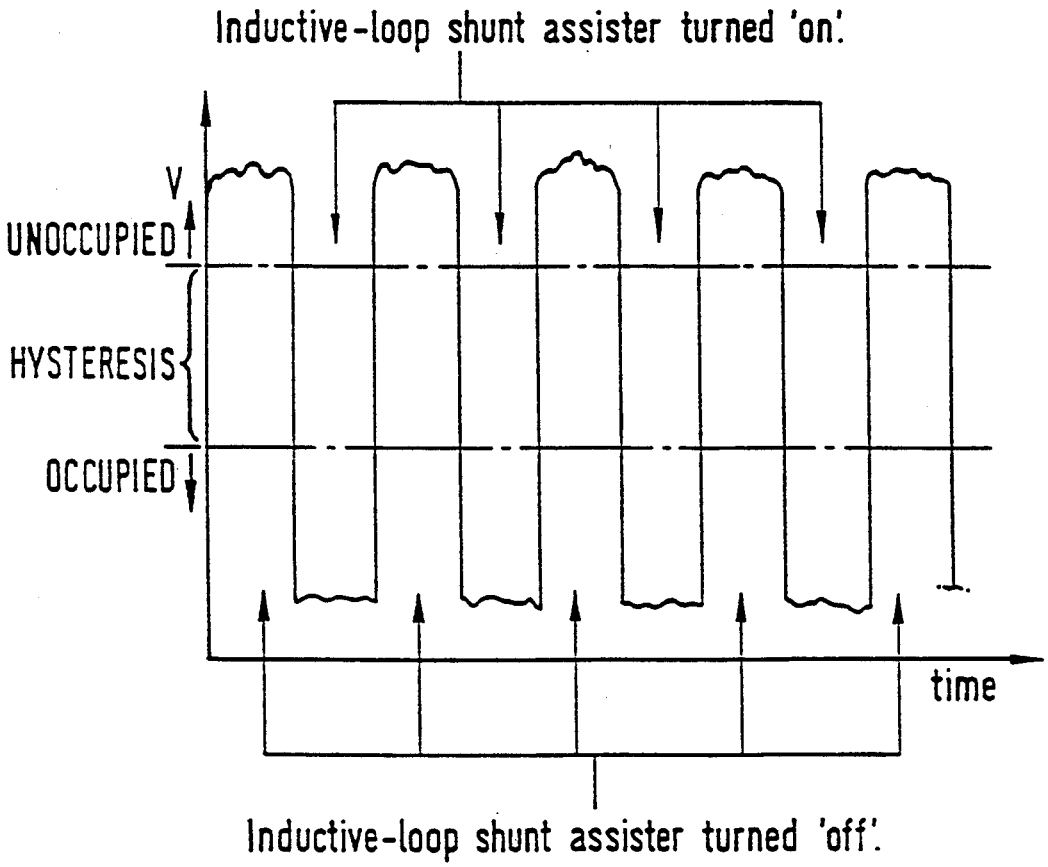
FIG. 4 is an explanatory diagram.

The efficacy of the shunt assist circuit is shown in FIG. 4 of the drawings which is a graph of voltage V at the track circuit detector with time, the shunt assist circuit being turned "on" and "off" periodically, i.e. the loop aerial 12 energized and de-energized periodically at say one second intervals. These results were obtained from test carried out on a section of line which had a history of bad-detection problems. To exacerbate the poor performance of the line a rust film was artificially introduced by application of moisture prior to the tests. With the shunt assist circuit turned "on" the voltage at the detector drops very nearly to zero thereby indicating very low train shunt impedance and hence that the track section is occupied by at least one wheel/axle set.

FIG. 4 shows an upper "unoccupied" line above which it is guaranteed that the track section should be unoccupied. It also shows a lower "occupied" line below which it should be guaranteed that the track section is occupied. The space between these lines represents the hysteresis of the track circuit detector which is typically in the form of an electromagnetic relay.

The results clearly show the improved performance of the track circuit when the shunt assist circuit is "on" and the non-detection of the train where the shunt assist circuit is "off".

The above described shunt assist circuit has further possible variations or alternative applications, namely:

1. Use of the shunt assist circuit to characterize track electrical performance by monitoring the electrical impedance of the wheel-rail circuit formed by the shunt assist circuit.

2. Use of the inductive loop aerial to convey data messages from train to trackside equipment in addition to the shunt assist function.

3. Use of the inductive loop aerial to monitor the condition of track. (making use of dynamic performance of wheel-rail contacts, noting effect on effective shunt impedance of the wheel-rail-vehicle circuit).

It will be appreciated that with the above described shunt assist circuit there is no need to insulate the wheel/axle sets from the bogie frames in order to direct current flow around the shunt assist circuit.

We claim:

1. A railway signalling system for the detection of a train within a defined section of track by means of a track circuit apparatus utilizing the rails within the section as part of an electric circuit and in which system the rails are electrically shunted by the wheels and axles of a railway vehicle of the train within the section, characterized in that a shunt assist circuit is provided on the railway vehicle, said circuit comprising:

an inductive loop aerial that is closely inductively coupled with the two rails beneath the railway vehicle; and an alternating power source connected to the loop aerial;

whereby when the loop aerial is energized by the alternating power source, a current is induced to flow in a circuit formed by a first wheel/axle set of the railway vehicle, through a first rail length underneath the railway vehicle, through a second wheel/axle set of the railway vehicle, and back through a second rail length underneath the railway vehicle to the first wheel/axle set.

2. A railway signalling system according to claim 1, wherein the loop aerial forms a primary winding of a transformer coupling, the secondary winding of which comprises the circuit formed by said first and second wheel/axle sets and said first and second lengths of rail between said first and second wheel/axle sets.

3. A railway signalling system according to claim 1, wherein the loop aerial is energized at a fixed frequency, and a tuning capacitor is provided in parallel with the loop aerial for tuning the loop aerial so that it resonates at the energizing frequency.

4. A railway signalling system according to claim 1, wherein the loop aerial is energizable at an adjustable frequency, whereby the frequency can be adjusted so that the loop aerial system is resonant.

5. A railway signalling system according to claim 4, wherein an optimizing circuit is provided which seeks the frequency at which the loop is resonant and automatically adjusts the adjustable frequency accordingly.

6. A railway signalling system according to claim 5, wherein the loop aerial is energized from a variable frequency oscillator through an amplifier, and the optimizing circuit includes a phase comparator which compares the phase of an input voltage of the amplifier with the phase of an output voltage of the amplifier to provide a control signal for adjusting the frequency of the oscillator in order to maintain the phase difference substantially constant.

* * * * *